US009284618B2

(12) United States Patent
Kohsaka et al.

(10) Patent No.: US 9,284,618 B2
(45) Date of Patent: Mar. 15, 2016

(54) HIGH STRENGTH HOT-ROLLED STEEL SHEET AND METHOD FOR MANUFACTURING THE SAME

(75) Inventors: Noriaki Kohsaka, Kanagawa (JP); Kazuhiro Seto, Chiba (JP); Hidetaka Kawabe, Chiba (JP); Yasushi Tanaka, Tokyo (JP)

(73) Assignee: JFE Steel Corporation (JP)

( * ) Notice: Subject to any disclaimer, the term of this patent is extended or adjusted under 35 U.S.C. 154(b) by 699 days.

(21) Appl. No.: 13/699,119

(22) PCT Filed: May 23, 2011

(86) PCT No.: PCT/JP2011/062306

§ 371 (c)(1), (2), (4) Date: Jan. 29, 2013

(87) PCT Pub. No.: WO2011/152328

PCT Pub. Date: Dec. 8, 2011

(65) Prior Publication Data

US 2013/0199678 A1 Aug. 8, 2013

(30) Foreign Application Priority Data

May 31, 2010 (JP) ..... 2010-123846

(51) Int. Cl.

| | |
|---|---|
| ***C21D 8/02*** | (2006.01) |
| ***C21D 6/00*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/08*** | (2006.01) |
| ***C22C 38/22*** | (2006.01) |
| ***C22C 38/24*** | (2006.01) |
| ***C22C 38/38*** | (2006.01) |

(52) U.S. Cl.

CPC ..... *C21D 8/0263* (2013.01); *C21D 6/005* (2013.01); *C21D 8/0226* (2013.01); *C21D 9/46* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/22* (2013.01); *C22C 38/24* (2013.01); *C22C 38/38* (2013.01); *C21D 2211/002* (2013.01); *C21D 2211/003* (2013.01)

(58) Field of Classification Search

CPC ..... C21D 8/0263
USPC ..... 148/602
See application file for complete search history.

(56) References Cited

U.S. PATENT DOCUMENTS

| | | | | |
|---|---|---|---|---|
| 6,364,968 | B1 | 4/2002 | Yasuhara et al. | |
| 2010/0108201 | A1 * | 5/2010 | Yokoi | C21D 6/005 148/504 |

FOREIGN PATENT DOCUMENTS

| | | | |
|---|---|---|---|
| EP | 1 391 526 | A2 | 2/2004 |
| GB | 2 382 590 | A | 6/2003 |
| JP | 10-195591 | A | 7/1998 |
| JP | 2000-109951 | A | 4/2000 |
| JP | 2000-178684 | A | 6/2000 |
| JP | 2001-247918 | A | 9/2001 |
| JP | 2003-49242 | A | 2/2003 |
| JP | 2004-76114 | A | 3/2004 |
| JP | 2004-197119 | A | 7/2004 |
| JP | 2005-206943 | A | 8/2005 |
| JP | 2009-41104 | A | 2/2009 |

OTHER PUBLICATIONS

Supplemental European Search Report dated Apr. 24, 2015 of corresponding European Application No. 11789731.4.

* cited by examiner

*Primary Examiner* — Jessee Roe
*Assistant Examiner* — Christopher Kessler
(74) *Attorney, Agent, or Firm* — DLA Piper LLP (US)

(57) ABSTRACT

A high strength hot-rolled steel sheet with a tensile strength of not less than 590 MPa which exhibits excellent bake hardenability and stretch-flangeability has a chemical composition including, in terms of mass %, C at 0.040 to 0.10%, Si at not more than 0.3%, Mn at 1.7 to 2.5%, P at not more than 0.030%, S at not more than 0.005%, Al at not more than 0.1% and N at 0.006 to 0.025%, and microstructure wherein a bainite phase represents not less than 60%, the total of a ferrite phase and a pearlite phase represents not more than 10%, and the bainite phase includes grains among which cementite grains have been precipitated at not less than $1.4\times10^4$ grains/$mm^2$ and the cementite grains have an average grain diameter of not more than 1.5 μm.

8 Claims, No Drawings

HIGH STRENGTH HOT-ROLLED STEEL SHEET AND METHOD FOR MANUFACTURING THE SAME

RELATED APPLICATIONS

This is a §371 of International Application No. PCT/JP2011/062306, with an international filing date of May 23, 2011 (WO 2011/152328 A1, published Dec. 8, 2011), which is based on Japanese Patent Application No. 2010-123846, filed May 31, 2010, the subject matter of which is incorporated herein by reference.

TECHNICAL FIELD

This disclosure relates to high strength hot-rolled steel sheets with a tensile strength of not less than 590 MPa which are suitably used for parts such as automobile structural parts and chassis and exhibit excellent bake hardenability and stretch-flangeability, and to a method for manufacturing the same.

BACKGROUND

Improving the fuel efficiency of vehicles has recently become an urgent necessity to control $CO_2$ emissions from the viewpoint of global environmental conservation. Thus, weight saving by reducing the thickness of parts has been required. In addition, improvements in safety, particularly crashworthiness of car bodies, have been required to ensure the safety of occupants in the event of a crash. Thus, both weight saving and strengthening of car bodies have been actively pursued.

For a car body to satisfy light weight and high strength at the same time, it is said to be effective to increase the strength of the material for automobile parts and to reduce the sheet thickness to such an extent that stiffness does not become a problem, thereby saving weight. High strength steel sheets have been recently actively used for automobile parts. In particular, there have been increasing demands for high strength steel sheets with a tensile strength of not less than 590 MPa. Weight saving effects are higher as the steel sheet used has higher strength. However, the higher the strength of a steel sheet, the more likely the occurrence of problems such as deteriorated shape fixability, an overload to a mold and the occurrence of cracks, necking or wrinkles being encountered during forming of the steel sheet.

To remedy these problems, according to known techniques, the amounts of elements incorporated into the steel and form a solid solution are controlled, and a strain aging hardening phenomenon that occurs during a baking step at 170° C. for 20 minutes is utilized such that the steel is worked and formed while its strength is low and its ductility is high and, after being formed, the steel is increased in strength through the baking step.

Japanese Unexamined Patent Application Publication No. 2005-206943 discloses a high strength hot-rolled steel sheet which contains C at 0.01 to 0.12%, Mn at 0.01 to 3% and N at 0.003 to 0.020%, has a bainite single phase or a mixed microstructure of a bainite phase and a second phase, and contains a controlled amount of solute nitrogen, thereby achieving excellent bake hardenability and aging resistance at ambient temperature.

Japanese Unexamined Patent Application Publication Nos. 2009-41104 and 2003-49242 disclose steel sheets with excellent strain aging hardenability and ductility which contain a controlled amount of solute nitrogen and have a microstructure including a ferrite phase at an area ratio of not less than 50%.

Japanese Unexamined Patent Application Publication No. 2004-76114 discloses that a high strength hot-rolled steel sheet with excellent bake hardenability is obtained by configuring the steel sheet to contain at least 3% of retained austenite.

Of the steel sheets described in JP '943, those which are free from such elements as chromium, molybdenum and nickel are insufficient in strength with a strength value being less than 590 MPa. Steel sheets to which such elements as chromium, molybdenum and nickel have been added exhibit a strength of not less than 590 MPa, but are insufficient in terms of costs and recyclability because of the addition of such elements. The higher the strength of a steel sheet, the smaller the increase in deformation stress (BH value) before and after an aging treatment, the difference in tensile strength (TS) (BHT value) before and after the aging treatment, and the hole expanding ratio (λ). However, that publication does not consider bake hardenability or stretch-flangeability at a steel sheet strength of not less than 590 MPa.

The steel sheets described in JP '104 and JP '242 are poor in stretch-flangeability because their microstructures are multiple phase microstructures mainly formed of a soft ferrite phase and a hard phase such as a martensite phase. In the steel sheet described in JP '114, good stretch-flangeability cannot be obtained because the steel sheet contains retained austenite which is very hard.

In view of the above circumstances, it could be helpful to provide a high strength hot-rolled steel sheet with a tensile strength of not less than 590 MPa which exhibits excellent bake hardenability and stretch-flangeability, and to provide a method for manufacturing such steel sheets.

SUMMARY

We thus provide:

[1] A high strength hot-rolled steel sheet with a tensile strength of not less than 590 MPa which has a chemical composition including, in terms of mass %, C at 0.040 to 0.10%, Si at not more than 0.3%, Mn at 1.7 to 2.5%, P at not more than 0.030%, S at not more than 0.005%, Al at not more than 0.1% and N at 0.006 to 0.025%, with the balance being represented by Fe and inevitable impurities, and has a microstructure in which a bainite phase represents not less than 60%, the total of a ferrite phase and a pearlite phase represents not more than 10%, and the bainite phase includes grains among which cementite grains have been precipitated at not less than $1.4\times10^4$ grains/mm$^2$ and the cementite grains have an average grain diameter of not more than 1.5 μm.

[2] The high strength hot-rolled steel sheet with a tensile strength of not less than 590 MPa described in [1], which further includes, in terms of mass %, one, or two or more of Cr, Mo and Ni at a total content of not more than 0.30%.

[3] The high strength hot-rolled steel sheet with a tensile strength of not less than 590 MPa described in [1] or [2], which further includes, in terms of mass %, one, or two or more of Nb, Ti and V at a total content of not more than 0.010%.

[4] The high strength hot-rolled steel sheet with a tensile strength of not less than 590 MPa described in any one of [1] to [3], which further includes, in terms of mass %, B at not more than 0.0015%.

[5] A method for manufacturing high strength hot-rolled steel sheets with a tensile strength of not less than 590 MPa, including heating a steel slab at 1100 to 1300° C., the steel slab having the chemical composition described in any one of [1] to [4], hot rolling the steel slab at a finish temperature of not less than ($Ar_3$ point+50° C.), naturally cooling the steel sheet for not less than 1.5 sec, cooling the steel sheet at an average cooling rate of not less than 30° C./sec, and coiling the steel sheet at a coiling temperature of 300 to 500° C.

The percentages % indicating the proportions of steel components are all mass %. The term "high strength hot-rolled steel sheet" means a steel sheet having a tensile strength (hereinafter, sometimes referred to as TS) of not less than 590 MPa, in particular a tensile strength of about 590 to 780 MPa. Further, the phrase "excellent bake hardenability and stretch-flangeability" means that the hole expanding ratio (hereinafter, sometimes referred to as λ) is not less than 80% and that when the steel sheet is preliminarily deformed with a tensile strain of 5% and is thereafter subjected to an aging treatment under conditions in which the steel sheet is held at a temperature of 170° C. for 20 minutes, the increase in deformation stress (hereinafter, also referred to as BH value) before and after the aging treatment is not less than 90 MPa, and the difference in TS (hereinafter, also referred to as BHT value) before and after the aging treatment is not less than 40 MPa.

High strength hot-rolled steel sheets with excellent bake hardenability and stretch-flangeability are obtained which exhibit TS of not less than 590 MPa, in particular TS of about 590 to 780 MPa, a BH value of not less than 90 MPa, a BHT value of not less than 40 MPa and λ of not less than 80%. Thus, the high strength hot-rolled steel sheets are suitable for applications such as automobile structural parts and chassis.

DETAILED DESCRIPTION

Our steel sheets and methods will be described in detail hereinbelow.

We provide improvements in the bake hardenability and stretch-flangeability of high strength hot-rolled steel sheets, wherein the chemical composition and the microstructure are controlled in a selected manner. Further, we studied heat patterns, focusing on hot-rolling, and discovered manufacturing conditions to obtain an improved microstructure that achieves improved bake hardenability, stretch-flangeability and strength.

That is, we provide that the steel sheet has a chemical composition with a high N content and has a microstructure in which a bainite phase represents not less than 60%, the total of a ferrite phase and a pearlite phase represents not more than 10%, and the bainite phase includes grains among which cementite grains have been precipitated at not less than $1.4\times10^4$ grains/mm$^2$ and the cementite grains have an average grain diameter of not more than 1.5 μm.

These features are important. Satisfaction of the above chemical composition and microstructure enables the steel sheet to exhibit high strength and excellent bake hardenability and stretch-flangeability.

First, the ranges in which and the reasons why the chemical components (the chemical composition) of the steel are limited will be described.

C: 0.040 to 0.10%

Carbon markedly improves bake hardenability and strength, and is therefore an effective element for increasing strength and obtaining good bake hardenability. It is necessary that carbon be present at not less than 0.040% to obtain these effects. However, the upper limit is specified to be 0.10% because an excessively high C content results in deteriorated hole expandability. Preferably, the C content is not less than 0.050% and not more than 0.080%.

Si: not more than 0.3%

Silicon has solid solution hardening effects and is also effective for improving ductility. If the Si content exceeds 0.3%, however, silicon forms complex precipitates with manganese and nitrogen, thus markedly adversely affecting bake hardenability and stretch-flangeability. Thus, the upper limit of the Si content is specified to be 0.3%. Nevertheless, for the above reason, an increase in the Si content tends to cause deterioration in bake hardenability and stretch-flangeability even if the Si content is not more than 0.3%, although such deteriorations are slow. Thus, it is desirable that the Si content be reduced as much as possible when steel sheets with good bake hardenability and stretch-flangeability are to be manufactured.

Mn: 1.7 to 2.5%

Manganese is effective for increasing strength and also has effects of lowering a transformation point and suppressing ferrite transformation. For these reasons, manganese is added at not less than 1.7%, and preferably not less than 1.9%. However, adding an excessively large amount of manganese causes the occurrence of abnormalities such as segregation and decreases ductility. Thus, the upper limit of the Mn content is specified to be 2.5%, and preferably 2.4%.

P: not more than 0.030%

Phosphorus is an effective element for solid solution hardening. If the P content exceeds 0.030%, however, phosphorus is liable to be segregated along grain boundaries and tends to deteriorate toughness and weldability. Thus, the P content is specified to be not more than 0.030%.

S: not more than 0.005%

In steel, sulfur is present as an inclusion and forms a sulfide with manganese to deteriorate stretch-flangeability. Thus, it is desirable that this element be reduced as much as possible. An S content of up to 0.005% is acceptable. Thus, the S content is specified to be not more than 0.005%.

Al: not more than 0.1%

Aluminum is used as a deoxidizing element. In excess of 0.1%, the use thereof becomes less advantageous because of costs and the occurrence of surface defects, and bake hardenability is lowered by the formation of AlN. Thus, the Al content is specified to be not more than 0.1%. The Al content is preferably not less than 0.005% for aluminum to sufficiently serve as a deoxidizer.

N: 0.006 to 0.025%

Nitrogen exhibits a strain aging hardening phenomenon by forming a Cottrell atmosphere, or by forming a cluster-like or nano-scale fine precipitate. Thus, the N content is specified to be not less than 0.006%. On the other hand, cold aging resistance is deteriorated if the N content exceeds 0.025%. Thus, the N content is specified to be not more than 0.025%, and is preferably not less than 0.010% and not more than 0.018%.

In addition to the above components, the steel may further contain the following components in accordance with intended use.

One, or two or more of Cr, Mo and Ni: total content of not more than 0.30%

Chromium, molybdenum and nickel are effective for increasing strength by solid solution hardening as well as for lowering the transformation point. Thus, the addition of these elements can improve manufacturing stability and can limit the yield. When they are added, the total content of one, or two or more of chromium, molybdenum and nickel is specified to be not more than 0.30% in view of costs and recyclability. The total content is preferably not less than 0.05% to obtain the above effects more efficiently.

One, or two or more of Nb, Ti and V: total content of not more than 0.010%

Niobium, titanium and vanadium have the effect of suppressing coarsening of austenite grains during rolling and therefore further improvements in strength and stretch-flangeability can be expected. On the other hand, they combine with carbon and nitrogen to form precipitates, thereby deteriorating bake hardenability. Thus, when they are added, the total content of one, or two or more of niobium, titanium and vanadium is specified to be not more than 0.010% in view of the balance among strength, stretch-flangeability and bake hardenability. The total content is preferably not more than 0.005% when particular importance is placed on bake hardenability. The total content is preferably not less than 0.001% to obtain the above effects more efficiently.

B: not more than 0.0015%

Boron has the effect of suppressing ferrite transformation to an extreme extent. Thus, improvements in manufacturing stability can be expected. On the other hand, any B content exceeding 0.0015% adversely affects toughness. Thus, when boron is added, the B content is specified to be not more than 0.0015%. The B content is more preferably not less than 0.0002% to obtain the above effect more efficiently.

The balance is represented by Fe and inevitable impurities.

Next, the ranges in which and the reasons why the steel microstructure, which is one of the important requirements, is limited will be described. The hot-rolled steel sheet has a microstructure in which a bainite phase represents not less than 60%, the total of a ferrite phase and a pearlite phase represents not more than 10%, and the bainite phase includes grains among which cementite grains have been precipitated at not less than $1.4\times10^4$ grains/mm$^2$ and the cementite grains have an average grain diameter of not more than 1.5 μm.

To manufacture a high strength steel sheet with a tensile strength of not less than 590 MPa based on the aforementioned chemical composition, the microstructure of the steel has to be strengthened concurrently. Bake hardenability and stretch-flangeability become more deteriorated with increasing proportions of a ferrite phase and a pearlite phase. On the other hand, a bainite phase is favorable in terms of both strength and stretch-flangeability. For these reasons, it is necessary that a bainite phase represent not less than 60%, and preferably not less than 80%.

The bainite phase is a microstructure in which cementite has been finely precipitated among grains. In the bainite phase as transformed, the cementite morphology is consistent with other precipitates as cementite. However, tempering causes the cementite orientation to become inconsistent. In the manufacturing method, it is conceivable that part of the formed bainite is slightly tempered during coiling. However, such tempered bainite exhibits effects similar to those of the normal bainite phase. Thus, there is no problem even if the bainite phase includes such tempered bainite.

The cementite orientation cannot be identified unless it is observed at such a high magnification ratio that can be achieved with a transmission electron microscope. It is not intended that such an orientation be identified. Thus, the microstructure including phases such as the bainite phase is observed with a scanning electron microscope at a magnification ratio of about 400 times as will be described later.

Further, the bainite phase can take various morphologic forms depending on the cooling rate at which the steel sheet is cooled from the austenite phase, as well as the coiling temperature. A good balance between bake hardenability and stretch-flangeability is achieved by a microstructure whose morphologic form is such that a large amount of fine cementite has been precipitated among grains of the bainite phase. Studies have revealed that target properties can be obtained when cementite grains have been precipitated at not less than $1.4\times10^4$ grains/mm$^2$ among grains of the bainite phase and the cementite grains have an average grain diameter of not more than 1.5 μm.

The precipitation of a ferrite phase and a pearlite phase markedly adversely affects bake hardenability and stretch-flangeability. Thus, the proportion of the total of a ferrite phase and a pearlite phase is specified to be not more than 10%, and preferably not more than 5%.

The balance of the microstructure is represented by a martensite phase and a retained austenite phase. The presence of such phases is acceptable as long as their respective proportions are not more than 30%. It is however preferable that these phases be suppressed from being precipitated or be transformed by tempering.

The total proportions of the phases, as well as the average grain diameter and the number of precipitated cementite grains can be determined by, for example, as follows.

The proportion of each phase was evaluated in the following manner. A central portion along the sheet thickness of a cross section parallel to the rolling direction (an L cross section) was etched with 5% Nital, and the corroded microstructure was photographed with respect to ten fields of view using a scanning electron microscope at 400× magnification. The images were analyzed on an image analysis software so as to identify respective phases. The proportion of each phase was determined based on the area ratio. The number of precipitated cementite grains was counted using images that had been photographed with respect to five fields of view with a scanning electron microscope at 1000× magnification. The equivalent circle diameter of each of the observed cementite grains was measured. The average grain diameter of cementite was determined from the diameters of the individual cementite grains.

Next, a method for manufacturing high strength hot-rolled steel sheets will be described.

First, a steel slab that has been conditioned to have the aforementioned chemical composition is heated at 1100 to 1300° C., hot rolled at a finish temperature of not less than ($Ar_3$ point+50° C.), subsequently naturally cooled for not less than 1.5 sec, cooled at a cooling rate of not less than 30° C./sec, and coiled at a coiling temperature of 300 to 500° C.

Heating of Slab at 1100 to 1300° C.

In heating prior to hot rolling, it is necessary that the slab form a substantially homogeneous austenite phase. In view of energy costs for heating the slab as well as the yield of the slab, the slab heating temperature is in the range of 1100 to 1300° C. If the temperature is less than 1100° C., a long time is required until a homogeneous austenite phase is obtained. On the other hand, heating at above 1300° C. causes adverse effects such as an increase in scale loss on the slab surface.

Finish Temperature of not Less than ($Ar_3$ Point+50° C.)

Below the $Ar_3$ point, the microstructure becomes such that ferrite grains are elongated, thus adversely affecting bake hardenability and stretch-flangeability. Even if the finish temperature is not less than the $Ar_3$ transformation point, hot rolling at immediately above the $Ar_3$ point causes austenite grains to have fine grain sizes and to be rolled while being unrecrystallized, thus large strain energy being accumulated. As a result, ferrite transformation is induced and allowed to proceed depending on the steel composition and the rate of cooling after the completion of the finish rolling, thus failing to achieve a proportion of the bainite phase of not less than 60%. Thus, hot rolling is performed such that the finish temperature is not less than ($Ar_3$ point+50° C.) so that the precipitation of ferrite is suppressed and a bainite phase proportion of not less than 60% is achieved. The $Ar_3$ point may be determined by, for example, a compression test using a transformation point measuring device.

Natural Cooling for not Less than 1.5 sec after Finish Rolling

The larger the strain energy that has been accumulated in the austenite phase during the hot rolling, the higher the force that drives the precipitation of a ferrite phase, thereby failing to obtain the target bainite phase. It is necessary that the austenite grains have been recrystallized to a certain extent to obtain a bainite phase in which cementite has been precipitated among grains. For this reason, the duration of the natural cooling after the finish rolling needs to be not less than 1.5 sec. Nevertheless, if the natural cooling time is excessively long, thick scales are formed on the surface of the steel sheet and surface defects are liable to occur. Thus, the natural cooling time is preferably not more than 5 sec.

Cooling at Average Cooling Rate of not Less than 30° C./sec

After hot rolling, the steel sheet needs to be cooled at a cooling rate of not less than 30° C./sec to suppress precipitation of a ferrite phase. The cooling rate is desirably as high as possible. The cooling rate is an average cooling rate from the completion of the natural cooling until coiling.

Coiling at Coiling Temperature of 300 to 500° C.

If the coiling temperature exceeds 500° C., a ferrite phase is precipitated to cause disadvantages in terms of bake hardenability and stretch-flangeability. Below 300° C., the target microstructure cannot be obtained and instead a microstructure based on a martensite phase and a retained austenite phase results. Thus, the coiling temperature is specified to be in the range of 300 to 500° C. Further improvements in quality can be sought by attaching a coil cover or performing a tempering step during continuous annealing.

Other manufacturing conditions may be usual conditions. For example, steel having a desired chemical composition may be produced by smelting in a furnace such as a converter furnace or an electric furnace and subsequent secondary smelting in a vacuum degassing furnace. From the viewpoints of productivity and quality, the steel is thereafter cast, preferably by a continuous casting method. After being cast, the steel is hot-rolled according to our method. The characteristics of the hot-rolled steel sheet are identical whether scales are attached on the surface or such scales have been removed by pickling. After the hot rolling, the steel sheet may be subjected to a pickling step, hot dip galvanization, electrogalvanization or a chemical conversion treatment. The zinc coating applied in galvanization is a coating of zinc or a coating based on zinc (namely, containing zinc at approximately not less than 90%). The zinc coating may contain alloying elements such as aluminum and chromium besides zinc, or may be alloyed after the galvanization.

The high strength hot-rolled steel sheets are obtained by the method described hereinabove.

Example 1

Steels Nos. A to L that had chemical compositions described in Table 1 were smelted in a converter furnace and continuously cast into slabs. The steel slabs were soaked and hot-rolled under conditions described in Table 2. Thus, coiled hot-rolled steel sheets Nos. 1 to 19 (sheet thickness: 2.6 mm to 4.0 mm) were manufactured.

Samples to be subjected to a tensile test, a bake hardenability test and a hole expansion test were obtained from tip and tail portions (both longitudinal end portions of the hot-rolled steel sheet) as well as longitudinal central portions of the coil in central areas in the width direction of the coil. Prior to sampling, the steel sheet was pickled, and the innermost loop and the outermost loop of the coil cut off beforehand to be excluded from the evaluation.

In the tensile test, a No. 5 tensile test piece specified in JIS Z 2201 was sampled in a direction perpendicular to the rolling direction and tested in accordance with JIS Z 2241. The average TS was determined from the measurement results of the tip and tail portions and the longitudinal central portions of the coil. The cross head speed was 10 mm/min.

To evaluate bake hardenability, BH and BHT values were determined. They can be obtained from Equations (1) and (2), respectively. The tensile test pieces and the tensile test conditions for the evaluation of bake hardenability were similar to those in the above tensile test.

BH value=(upper yield point after preliminarily deformed with 5% tensile strain and aging treatment at 170° C. for 20 min)−(stress applied during preliminary deformation with 5% tensile strain) Equation (1)

BHT value=(TS after preliminarily deformed with 5% tensile strain and aging treatment at 170° C. for 20 min)−(TS without preliminary deformation treatment) Equation (2)

As an indicator of stretch-flangeability, a hole expansion test was carried out. Test pieces were fabricated under piercing conditions in which the hole diameter was 10 mm and the clearance relative to the sheet thickness was 12.5%. The test pieces were tested in accordance with The Japan Iron and Steel Federation Standards JFS T 1001. The hole expanding ratio λ was determined from Equation (3) below:

$$\lambda=(d_1-10)/10 \quad \text{Equation (3)}$$

wherein $d_1$ is the hole diameter after the hole expansion test.

The proportion of each phase in the metal microstructure was evaluated in the following manner. A central portion along the sheet thickness of a cross section parallel to the rolling direction (an L cross section) was etched with 5% Nital, and the corroded microstructure was photographed with respect to ten fields of view using a scanning electron microscope at 400× magnification. The images were analyzed on an image analysis software so as to identify respective phases. The proportion of each phase was determined based on the area ratio. The number of precipitated cementite grains was counted using images that had been photographed with respect to five fields of view with a scanning electron microscope at 1000× magnification. The respective equivalent circle diameters and the number of the observed cementite grains were measured. The average grain diameter of cementite was determined from the diameters of the individual cementite grains. The number of the cementite grains relative to the area of the observation fields of view was calculated to determine the number of the cementite grains per unit area.

The results are described in Table 3. In Table 3, $V_1$ indicates the proportion of a bainite phase, $V_2$ the proportion of a ferrite phase and a pearlite phase, N the number per unit area of the cementite grains precipitated among grains in the bainite phase, and d the average grain diameter of the cementite grains precipitated among grains in the bainite phase.

TABLE 1

| Steel No. | Chemical composition (mass %) C | Si | Mn | P | S | Al | N | Others | $Ar_3$ point ° C. | Remarks |
|---|---|---|---|---|---|---|---|---|---|---|
| A | 0.060 | 0.010 | 2.20 | 0.011 | 0.0023 | 0.039 | 0.015 | — | 747 | EX. |
| B | 0.078 | 0.007 | 1.93 | 0.014 | 0.0021 | 0.042 | 0.008 | — | 752 | EX. |
| C | 0.064 | 0.280 | 2.17 | 0.020 | 0.0024 | 0.045 | 0.016 | — | 754 | EX. |
| D | 0.049 | 0.011 | 2.35 | 0.015 | 0.0020 | 0.038 | 0.016 | — | 744 | EX. |
| E | 0.059 | 0.011 | 1.71 | 0.013 | 0.0021 | 0.040 | 0.015 | Mo: 0.13, Nb: 0.0014 | 752 | EX. |
| F | 0.060 | 0.008 | 2.15 | 0.011 | 0.0025 | 0.041 | 0.016 | Ni: 0.01, Ti: 0.0012, B: 0.001 | 749 | EX. |
| G | 0.064 | 0.012 | 1.80 | 0.012 | 0.0024 | 0.044 | 0.016 | Mo: 0.02, Cr: 0.05, V: 0.0010 | 745 | EX. |
| H | 0.035 | 0.234 | 2.10 | 0.012 | 0.0022 | 0.045 | 0.015 | — | 758 | COMP. EX. |
| I | 0.120 | 0.004 | 2.11 | 0.016 | 0.0026 | 0.040 | 0.014 | — | 732 | COMP. EX. |
| J | 0.060 | 0.411 | 2.08 | 0.012 | 0.0020 | 0.047 | 0.013 | — | 765 | COMP. EX. |
| K | 0.061 | 0.009 | 1.55 | 0.013 | 0.0023 | 0.043 | 0.015 | — | 782 | COMP. EX. |
| L | 0.061 | 0.016 | 2.27 | 0.016 | 0.0027 | 0.061 | 0.005 | — | 743 | COMP. EX. |

TABLE 2

| Steel sheet No. | Steel No. | Hot rolling conditions Heating temp. ° C. | Finish temp. ° C. | Natural cooling time s | Cooling rate ° C./s | Coiling temp. ° C. | Remarks |
|---|---|---|---|---|---|---|---|
| 1 | A | 1230 | 854 | 1.8 | 75 | 401 | EX. |
| 2 | | 1210 | 865 | 1.7 | 90 | 324 | EX. |
| 3 | | 1250 | 826 | 1.7 | 85 | 489 | EX. |
| 4 | | 1230 | 841 | 1.8 | 75 | 249 | COMP. EX. |
| 5 | | 1220 | 850 | 1.9 | 80 | 581 | COMP. EX. |
| 6 | | 1230 | 715 | 1.7 | 80 | 407 | COMP. EX. |

TABLE 2

| Steel sheet No. | Steel No. | Hot rolling conditions Heating temp. ° C. | Finish temp. ° C. | Natural cooling time s | Cooling rate ° C./s | Coiling temp. ° C. | Remarks |
|---|---|---|---|---|---|---|---|
| 7 | | 1220 | 862 | 1.2 | 80 | 406 | COMP. EX. |

TABLE 2-continued

| Steel sheet No. | Steel No. | Hot rolling conditions Heating temp. ° C. | Finish temp. ° C. | Natural cooling time s | Cooling rate ° C./s | Coiling temp. ° C. | Remarks |
|---|---|---|---|---|---|---|---|
| 8 | | 1220 | 852 | 1.8 | 20 | 411 | COMP. EX. |
| 9 | B | 1230 | 863 | 1.7 | 80 | 385 | EX. |
| 10 | C | 1220 | 859 | 1.7 | 75 | 415 | EX. |
| 11 | D | 1230 | 843 | 1.7 | 70 | 400 | EX. |
| 12 | E | 1220 | 845 | 1.8 | 75 | 406 | EX. |
| 13 | F | 1240 | 855 | 1.8 | 80 | 423 | EX. |
| 14 | G | 1220 | 869 | 1.6 | 85 | 397 | EX. |
| 15 | H | 1210 | 846 | 1.9 | 80 | 374 | COMP. EX. |
| 16 | I | 1240 | 852 | 1.8 | 75 | 388 | COMP. EX. |
| 17 | J | 1230 | 876 | 1.8 | 80 | 405 | COMP. EX. |
| 18 | K | 1220 | 881 | 1.9 | 75 | 408 | COMP. EX. |
| 19 | L | 1230 | 841 | 1.7 | 70 | 402 | COMP. EX. |

TABLE 3

| Steel sheet No. | Mechanical properties TS MPa | BH MPa | BHT MPa | λ % | Metal microstructure Microstructure morphology | $V_1$ % | $V_2$ % | N $\times 10^4$ grains/mm$^2$ | d μm | Remarks |
|---|---|---|---|---|---|---|---|---|---|---|
| 1 | 638 | 121 | 62 | 127 | B + M | 94 | 0 | 1.8 | 1.2 | EX. |
| 2 | 681 | 110 | 46 | 84 | B + M | 67 | 0 | 1.5 | 1.4 | EX. |
| 3 | 603 | 94 | 41 | 106 | F + B | 96 | 4 | 1.4 | 1.3 | EX. |
| 4 | 705 | 84 | 29 | 76 | B + M | 41 | 0 | 0.8 | 0.7 | COMP. EX. |

TABLE 3

| Steel sheet No. | Mechanical properties TS MPa | BH MPa | BHT MPa | λ % | Metal microstructure Microstructure morphology | $V_1$ % | $V_2$ % | N $\times 10^4$ grains/mm$^2$ | d μm | Remarks |
|---|---|---|---|---|---|---|---|---|---|---|
| 5 | 574 | 53 | 24 | 69 | F + B + M | 81 | 12 | 1.5 | 2.3 | COMP. EX. |
| 6 | 583 | 41 | 8 | 55 | F + B + M | 72 | 15 | 0.7 | 1.3 | COMP. EX. |
| 7 | 653 | 108 | 43 | 45 | F + B + M | 48 | 51 | 0.5 | 0.9 | COMP. EX. |
| 8 | 513 | 8 | 0 | 66 | F + B | 24 | 76 | 0.7 | 1.7 | COMP. EX. |
| 9 | 657 | 138 | 68 | 81 | B + M | 92 | 0 | 1.7 | 1.1 | EX. |

TABLE 3-continued

| | Mechanical properties | | | | Metal microstructure | | | | | |
|---|---|---|---|---|---|---|---|---|---|---|
| Steel sheet No. | TS MPa | BH MPa | BHT MPa | λ % | Microstructure morphology | $V_1$ % | $V_2$ % | N $\times 10^4$ grains/mm$^2$ | d μm | Remarks |
| 10 | 640 | 98 | 43 | 82 | F + B | 95 | 5 | 1.5 | 1.3 | EX. |
| 11 | 602 | 101 | 44 | 133 | B + M | 98 | 0 | 1.5 | 1.3 | EX. |
| 12 | 681 | 95 | 43 | 107 | B + M | 96 | 0 | 1.6 | 1.2 | EX. |
| 13 | 670 | 98 | 43 | 105 | B | 100 | 0 | 1.8 | 1.2 | EX. |
| 14 | 678 | 94 | 41 | 104 | B + M | 97 | 0 | 1.7 | 1.1 | EX. |
| 15 | 574 | 91 | 38 | 112 | F + B | 98 | 2 | 1.4 | 0.8 | COMP. EX. |
| 16 | 751 | 101 | 44 | 38 | B + M | 67 | 0 | 2.3 | 1.8 | COMP. EX. |
| 17 | 622 | 60 | 21 | 61 | F + B | 82 | 18 | 1.1 | 1.3 | COMP. EX. |
| 18 | 562 | 97 | 46 | 109 | F + B | 98 | 2 | 1.5 | 1.3 | COMP. EX. |
| 19 | 605 | 12 | 0 | 121 | B + M | 95 | 0 | 2.0 | 1.1 | COMP. EX. |

From Table 3, all the steel sheets obtained in the EXAMPLES exhibited high strength and good bake hardenability and stretch-flangeability with TS of 590 to 780 MPa, a BH value of not less than 90 MPa, a BHT value of not less than 40 MPa and λ of not less than 80%.

TS mainly depends on the amounts of solid solution hardening elements such as carbon, silicon and manganese, as well as on strengthening of the microstructure due to a bainite phase or further a martensite phase. Both bake hardenability and hole expanding ratio tend to depend on the proportion of the bainite phase. Further, even if the bainite proportion is high, as can be seen from the results of the steel sheet No. 7, good stretch-flangeability cannot be obtained if the number per unit area of cementite grains precipitated among grains of the bainite phase is small.

On the other hand, the steel sheet No. 4 failed to achieve good bake hardenability and stretch-flangeability because its microstructure was based on a martensite phase. Similarly, the steel sheet No. 6 exhibited lower strength, bake hardenability and stretch-flangeability because a ferrite phase had grown excessively. The steel sheets Nos. 15 to 19, whose compositions were outside the claimed range, were shown to be poor in strength if the C content was low. On the other hand, a lower hole expanding ratio resulted when carbon was excessively added. When the Si content was high, a ferrite phase was easily precipitated, and bake hardenability and stretch-flangeability were deteriorated due to the formation of precipitates which were probably of silicon origin. It was shown that target strength was not obtained when the Mn content was low.

INDUSTRIAL APPLICABILITY

Our steel sheets can be suitably used for various parts that require high strength, such as automobile parts, and typically automobile outer panels. Besides automobile parts, the steel sheets are suited for applications where strict dimensional accuracy and workability are required, for example, in the building and home appliance fields.

The invention claimed is:

1. A high strength hot-rolled steel sheet with a tensile strength of not less than 590 MPa which has a chemical composition comprising, in terms of mass %, C at 0.040 to 0.10%, Si at not more than 0.3%, Mn at 1.7 to 2.5%, P at not more than 0.030%, S at not more than 0.005%, Al at not more than 0.1% and N at 0.006 to 0.025%, with the balance being represented by Fe and inevitable impurities, and has a microstructure in which a bainite phase represents not less than 60% on an area ratio basis, a total of a ferrite phase and a pearlite phase represents not more than 10% on an area ratio basis, and the bainite phase includes grains among which cementite grains have been precipitated at not less than $1.4\times 10^4$ grains/mm$^2$ and the cementite grains have an average grain diameter of not more than 1.5 μm.

2. The high strength hot-rolled steel sheet according to claim 1, further comprising, in terms of mass %, one, or two or more of Cr, Mo and Ni at a total content of not more than 0.30%.

3. The high strength hot-rolled steel sheet according to claim 2, further comprising, in terms of mass % , one, or two or more of Nb, Ti and V at a total content of not more than 0.010%.

4. The high strength hot-rolled steel sheet according to claim 3, further comprising, in terms of mass %, B at not more than 0.0015%.

5. The high strength hot-rolled steel sheet according to claim 2, further comprising, in terms of mass %, B at not more than 0.0015%.

6. The high strength hot-rolled steel sheet according to claim 1, further comprising, in terms of mass %, one, or two or more of Nb, Ti and V at a total content of not more than 0.010%.

7. The high strength hot-rolled steel sheet according to claim 6, further comprising, in terms of mass %, B at not more than 0.0015%.

8. The high strength hot-rolled steel sheet according to claim 1, further comprising, in terms of mass %, B at not more than 0.0015%.

* * * * *